US007210681B2

(12) United States Patent
Asako

(10) Patent No.: US 7,210,681 B2
(45) Date of Patent: May 1, 2007

(54) PAPER DISCHARGE UNIT AND PRINTING APPARATUS EMPLOYING THE PAPER DISCHARGE UNIT

(75) Inventor: Kouji Asako, Aasaka (JP)

(73) Assignee: Fujifilm Corporation, Tokyo (JP)

( * ) Notice: Subject to any disclaimer, the term of this patent is extended or adjusted under 35 U.S.C. 154(b) by 462 days.

(21) Appl. No.: 10/696,570

(22) Filed: Oct. 30, 2003

(65) Prior Publication Data

US 2004/0140609 A1 Jul. 22, 2004

(30) Foreign Application Priority Data

Oct. 30, 2002 (JP) ..... 2002-316031

(51) Int. Cl.
*B65H 29/00* (2006.01)

(52) U.S. Cl. ..... 271/279; 271/298; 193/8

(58) Field of Classification Search ..... 271/279, 271/298, 264, 207; 193/8, 14, 29, 4, 2 R; 399/405, 407; 209/656
See application file for complete search history.

(56) References Cited

U.S. PATENT DOCUMENTS 3,955,680 A * 5/1976 Botula ..... 209/696
4,662,522 A * 5/1987 Kokubun et al. ..... 209/656
5,592,298 A * 1/1997 Caruso ..... 358/504
6,661,978 B2 * 12/2003 Brewington ..... 399/19

FOREIGN PATENT DOCUMENTS

| | | | |
|---|---|---|---|
| JP | 3-56755 U | | 5/1991 |
| JP | 5305927 A | | 11/1993 |
| JP | 6080294 A | | 3/1994 |
| JP | 6-127786 | * | 5/1994 |
| JP | 2001-162871 | | 6/2001 |

* cited by examiner

*Primary Examiner*—Patrick Mackey
*Assistant Examiner*—Thomas Morrison
(74) *Attorney, Agent, or Firm*—Sughrue Mion, PLLC

(57) ABSTRACT

A printer having a plurality of printing engines that eject papers to a common chute box is provided, wherein papers are discharged in an aligned state, even in the case that papers of different sizes are ejected. Papers of different sizes are inserted through slots of the chute box. Movement on a guide member of the papers, having the largest width from among the inserted papers, is regulated by side walls of the chute box. Meanwhile, widthwise movement of papers of a smaller size than the largest papers is regulated by one of the side walls of the chute box and a guide rib.

6 Claims, 7 Drawing Sheets

PAPER DISCHARGE UNIT AND PRINTING APPARATUS EMPLOYING THE PAPER DISCHARGE UNIT

BACKGROUND OF THE INVENTION

1. Field of the Invention

The present invention relates to a paper discharge unit for discharging papers on which images, for example, have been printed by a plurality of printing engines. The present invention also relates to a printing apparatus that employs the paper discharge unit.

2. Description of the Related Art

Recently, printing services, wherein images which have been photographed with digital cameras are printed, are being provided, along with the spread of digital cameras. As a manner in which these printing services are provided, there is known a printing apparatus provided with a plurality of printing engines, each housing paper therein (refer to Japanese Unexamined Patent Publication No. 2001-162871). The printing apparatus is configured to receive a recording medium such as a SmartMedia™ having image data recorded therein, and to print images represented by the image data with the plurality of printing engines within the apparatus. By providing a plurality of printing engines, image data can be printed in parallel. Thus, high speed, efficient printing processes are enabled.

Various types of paper sizes exist for the paper on which images are printed. Examples include: postcard size, 3×5, 4×6, and CD size. Each printing engine performs printing on papers of a plurality of paper sizes. A discharge mechanism capable of discharging the largest print size is provided, in order to enable discharge of all of the print sizes.

The discharge mechanism is constituted by a chute box, which guides the papers output by the print engines to an ejection opening. For example, the chute box of a printing apparatus, which prints onto papers of the postcard size, 3×5, 4×6, and the CD size, is capable of discharging papers of the 4×6 size, and has a width so that the 4×6 size papers do not rotate therein.

However, when papers smaller than the 4×6 size move through the chute box gaps exist between the chute box and the papers. Therefore, the papers rotate within the discharge mechanism. When the papers fall to the ejection opening, the papers may be in disarray, or flipped over. Therefore, a problem exists in that when a user removes the papers from the ejection opening, they are not organized.

SUMMARY OF THE INVENTION

The present invention has been developed in view of the problem described above. It is an object of the present invention to provide a paper discharge unit which is capable of discharging papers so that they are arranged in position, even in the case that papers of different sizes are inserted thereinto. It is another object of the present invention to provide a printing apparatus that employs the discharge unit.

The paper discharge unit of the present invention comprises:

a chute box having a plurality of slots for inserting papers of different sizes thereinto, provided at different heights in a first surface thereof;

a plurality of guide members, inclined downwardly from the plurality of slots, provided to form a gap through which the papers fall toward a second surface of the chute box facing the first surface in which the plurality of slots are formed; wherein the chute box is provided with side walls for regulating widthwise movement on the guide member of a first paper, having the largest width among the papers; and each of the guide members is provided with a guide rib for regulating widthwise movement of a second paper, which is smaller than the first paper, in cooperation with one of the side walls, the guide ribs extending from the slots to the second surface of the chute box.

The printing apparatus of the present invention comprises:

a plurality of printing engines capable of discharging papers of different sizes on which images are printed, the printing engines being housed in the printing apparatus in a stacked manner;

a chute box having a plurality of slots for inserting papers of different sizes discharged by the printing engines thereinto, provided corresponding to each of the printing engines in a first surface thereof;

a plurality of guide members, inclined downwardly from the plurality of slots, provided to form a gap through which the papers fall toward a second surface of the chute box facing the first surface in which the plurality of slots are formed; wherein the chute box is provided with side walls for regulating widthwise movement on the guide member of a first paper, having the largest width among the papers; and each of the guide members is provided with a guide rib for regulating widthwise movement of a second paper, which is smaller than the first paper, in cooperation with one of the side walls, the guide ribs extending from the slots to the second surface of the chute box.

Note that the "guide ribs" may be provided so that the width between them and the one of the side walls becomes narrower toward the second surface of the chute box.

In addition, the "guide ribs" may be provided so that upper edges thereof approach the second surface of the chute box toward the end of the guide ribs away from the slots.

Downwardly extending sheet members may be provided at the distal ends of the guide members, the sheet members being in contact with the second surface of the chute box.

Further, the sheet member may be provided with a first space for both edges in the width direction of the first paper to be inserted in, and a second space for both edges in the width direction of the second paper to be inserted in, in the case that the first and second papers are curled in the cross section of their width directions.

Still further, a paper housing portion for stacking and housing the papers may be provided below the chute box; and a position controlling member for causing the papers which fall through the chute box to be stacked in the same direction may be provided between the chute box and the paper housing portion.

According to the paper discharge unit of the present invention and the printing apparatus using the same, when papers are inserted into the chute box and move therethrough while being guided, movement of the first paper, having the largest width, is regulated by the side walls of the chute box. Meanwhile, movement of the second paper is regulated by one of the side walls and the guide rib. Therefore, even in the case that papers of different sizes are inserted from the slots, the second paper does not rotate within the chute box. Accordingly, the first papers and the second papers are respectively discharged from the chute box at substantially uniform positions.

The guide ribs may be provided so that the width between them and the one of the side walls becomes narrower toward the second surface of the chute box. In this case, even if a plurality of the second papers are inserted into the slots in a state that they are slightly shifted in the width directions thereof, they are caused to fall from substantially the same position.

The guide ribs may also be provided so that upper edges thereof approach the second surface of the chute box toward the end of the guide ribs away from the slots. In this case, the first papers which pass over the guide ribs can be positively be guided to the gap formed between the guide member and the second surface of the chute box.

Downwardly extending sheet members may be provided at the distal ends of the guide members, the sheet members being in contact with the second surface of the chute box. In this case, the papers which fall through the gap are urged toward the second surface of the chute box. Therefore, the papers do not strike other guide members along their descent.

Further, the sheet member may be provided with a first space for both edges in the width direction of the first paper to be inserted in, and a second space for both edges in the width direction of the second paper to be inserted in, in the case that the first and second papers are curled in the cross section of their width directions. In this case, rotation of the first papers and the second papers is prevented.

Still further, a paper housing portion for stacking and housing the papers may be provided below the chute box; and a position controlling member for causing the papers which fall through the chute box to be stacked in the same direction may be provided between the chute box and the paper housing portion. In this case, the papers which fall into the paper housing portion may be stacked in an arranged state.

DESCRIPTION OF THE PREFERRED EMBODIMENTS

Figure 1:
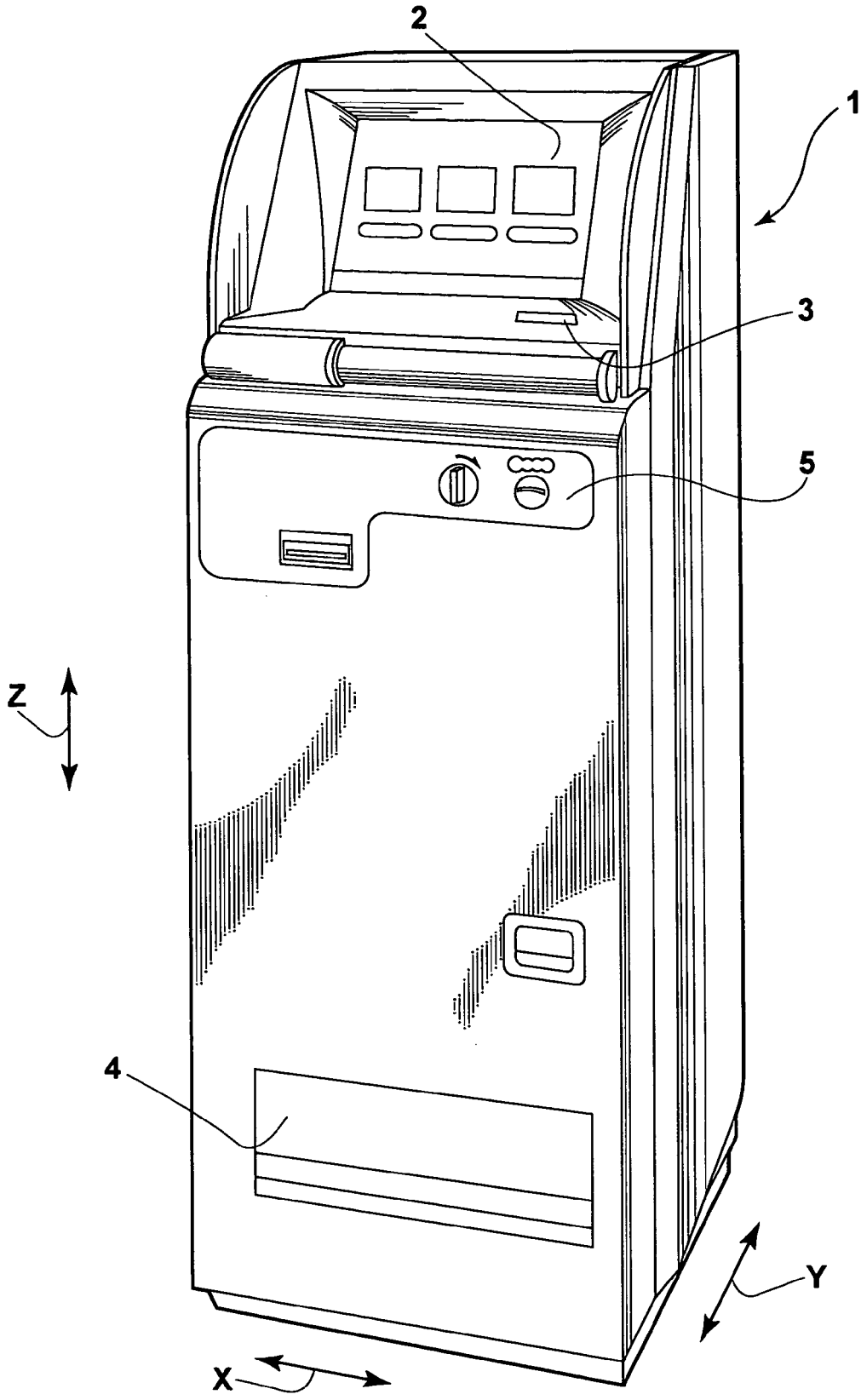
FIG. 1 is a perspective view of a printing apparatus according to a preferred embodiment of the present invention.

Hereinafter, an embodiment of the present invention will be described with reference to the attached drawings. FIG. 1 is a perspective view of a printing apparatus 1. The printing apparatus 1 is installed at a storefront, for example, to provide a printing service, wherein users print images represented by image data photographed by digital cameras, on a self-serve basis. The printing apparatus 1 comprises: a touch panel monitor 2; a media insertion slot 3; a print discharge opening 4; and a payment slot 5. When a user performs printing of images using the printing apparatus, he first inserts a recording medium into the media insertion slot 3. Then, the images recorded in the recording medium are displayed on the touch panel monitor 2. At this time, the user selects the images to be printed, sets print sizes of the images, sets the number of prints, and inserts money for a charge corresponding to the number of prints into the payment slot. Thereafter, the printing apparatus performs printing of the images, and papers on which the images have been printed are discharged from the print discharge opening 4.

Figure 2:
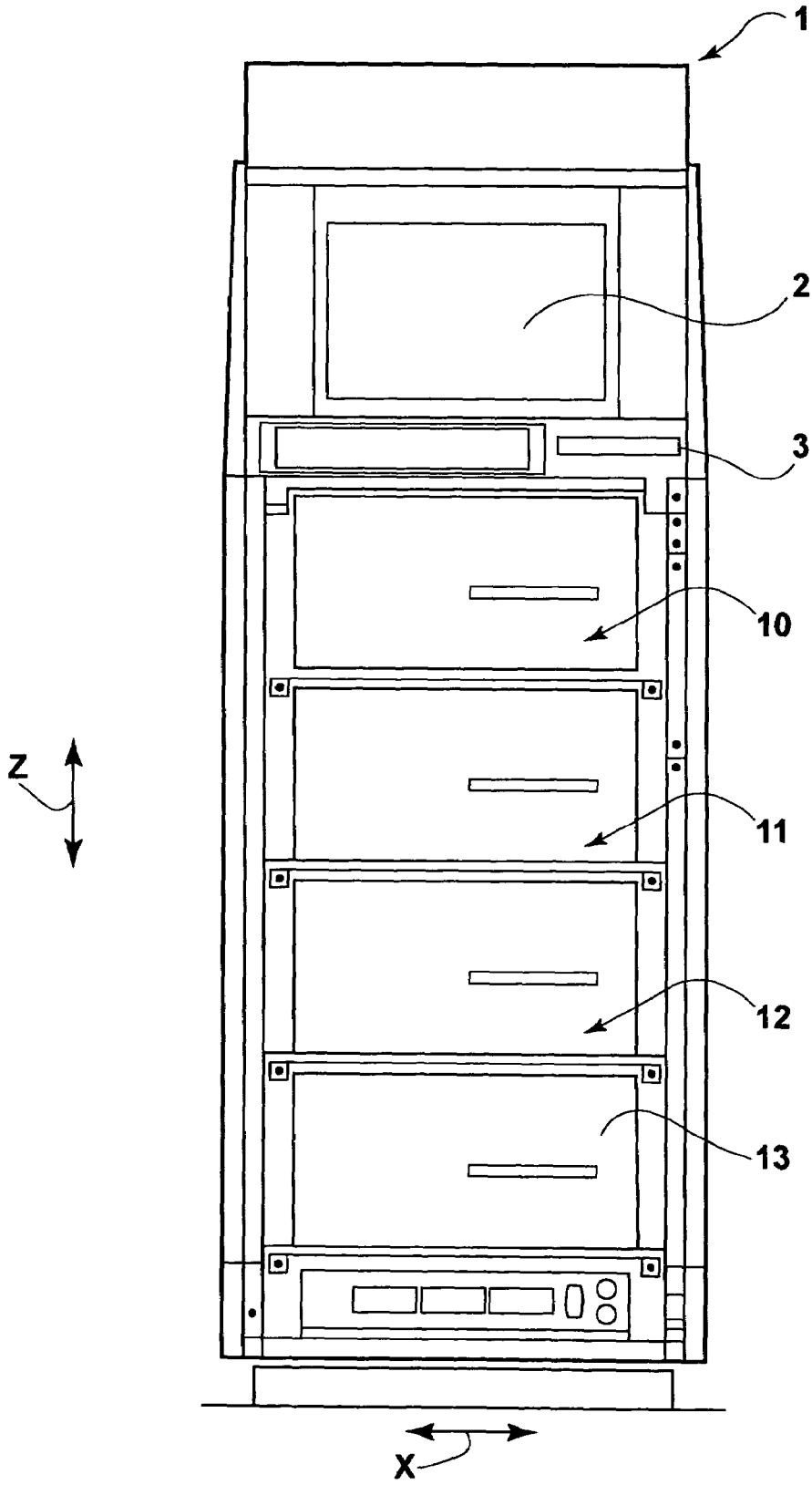
FIG. 2 is a view showing printing engines of the printing apparatus of FIG. 1.

The printing apparatus 1 is constructed so as to enable provision of a plurality of printing engines 10 therein, as shown in FIG. 2. The printing engines 10 perform printing of images on papers. Four print engines 10, 11, 12, and 13 are provided in the printing apparatus 1 shown in FIG. 2. The print engines 10, 11, 12, and 13 perform color printing on thermal recording paper by the thermo-autochrome method, for example. The printing engines 10, 11, 12, and 13 house papers corresponding to a plurality of print sizes (3×5, postcard size, CD size and the like) in the form of curled sheets. When the user specifies a print size from among 4×6, 3×5, postcard size, CD size, and the like, each of the printing engines 10, 11, 12, and 13 performs printing of image data onto papers of the specified print size.

Figure 3:
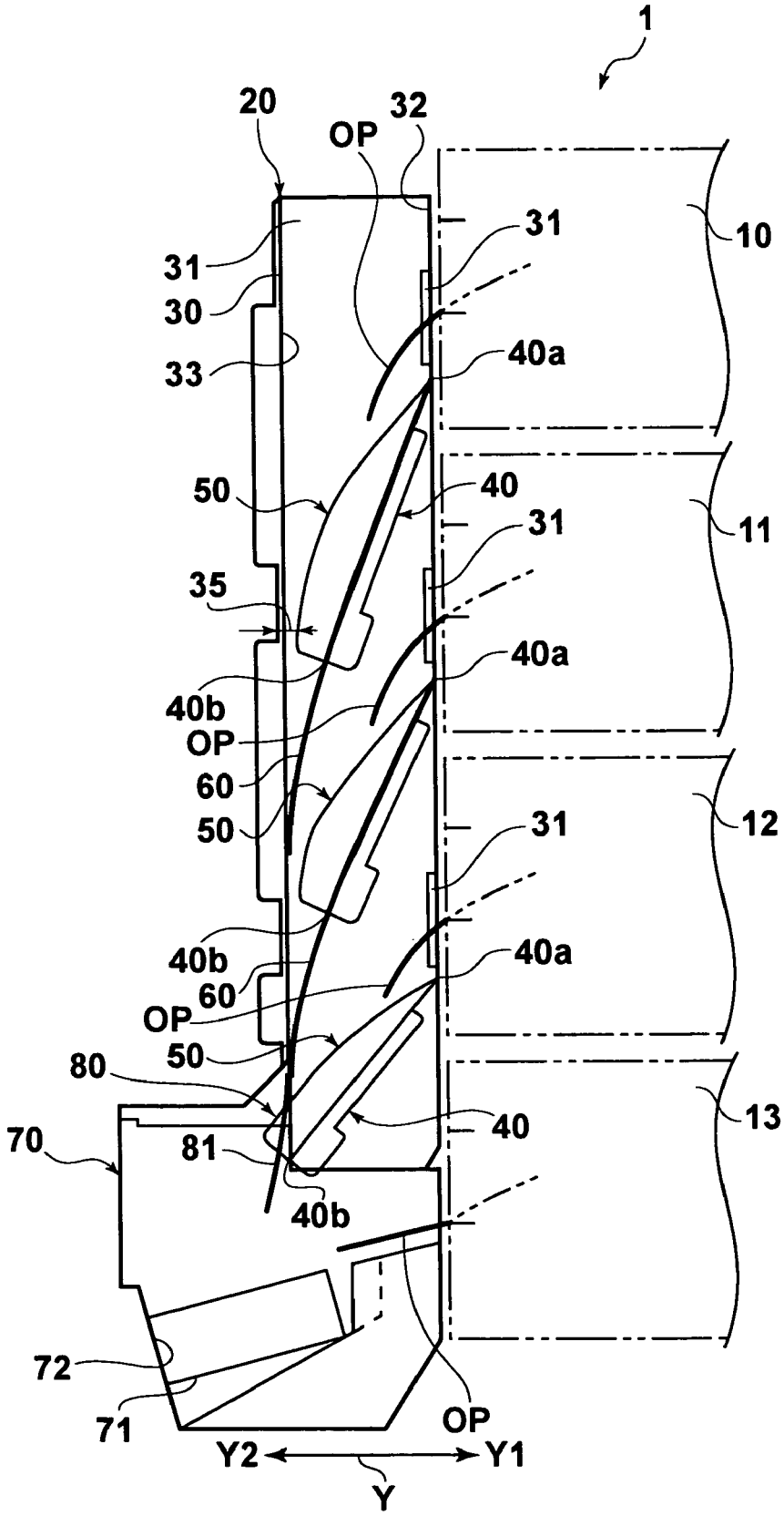
FIG. 3 is a sectional view of a paper discharge unit according to a preferred embodiment of the present invention.
Figure 4:
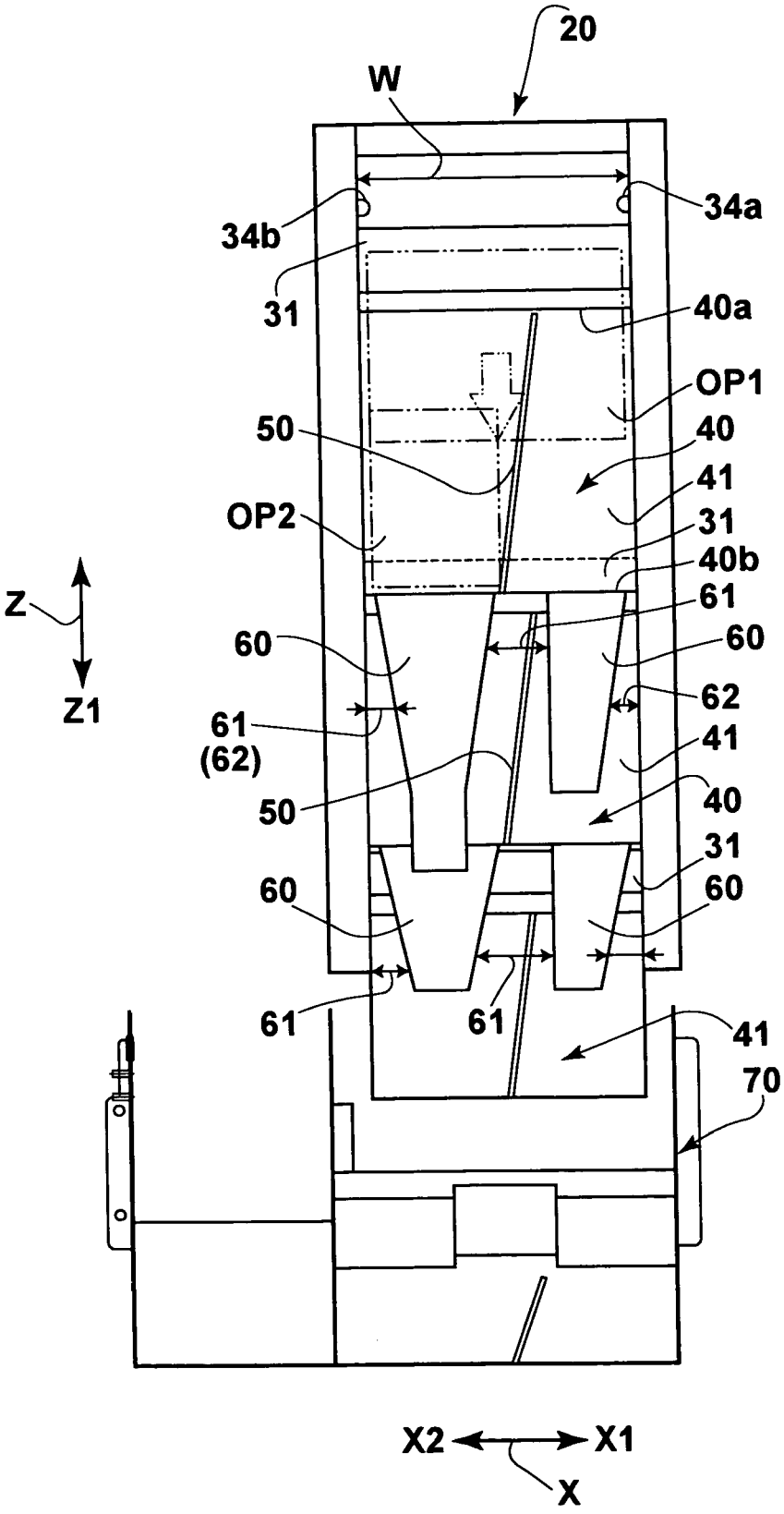
FIG. 4 is a front view of the paper discharge unit of FIG. 3.

FIG. 3 is a sectional view of a paper stacking portion 20 (paper discharge unit) employed by the printing apparatus of FIG. 1. FIG. 4 is a front view of the paper stacking portion 20. The paper stacking portion 20 of FIG. 3 and FIG. 4 is mounted on the paper discharge side of the printing engines 10, 11, 12, and 13. The paper stacking portion 20 comprises a chute box 30, a plurality of guide members 40, guide ribs 50, and a paper housing portion 70. The chute box 30 of FIG. 3 is provided for papers OP discharged from the printing engines 10, 11, 12, and 13 to fall through to the paper housing portion 70. Slots 31 are formed for insertion of the papers OP into the chute box 30. The slots 31 are provided at a plurality of heights, corresponding to the paper ejection openings of the printing engines 10, 11, 12, and 13.

The chute box 30 of FIG. 4 comprises a hollow portion 32 for guiding the papers OP, which have been inserted through the slots 31, to the discharge opening 4. The width W of the hollow portion 32 is formed so as to allow a first paper OP1 having the largest size (e.g., 4×6), which is ejected from the printing engines 10, 11, 12, and 13 (inserted through the slots 31), to pass therethrough. Further, the width W is formed to be shorter than the diagonal length of the first paper OP1, so that it does not rotate within the chute box 30. That is, the side walls of the chute box 30 restrict movement of the first paper OP1 in the widthwise direction thereof (the direction indicated by arrow X).

The guide members 40 are provided at the lower sides of the slots 31 of the chute box 30. One end 40*a* of each of the guide members 40 is positioned at the lower side of the corresponding slot 31, and the other end 40*b* is positioned toward a second surface 33 of the chute box 30, which faces the surface in which the slots 31 are formed. The guide members 40 are also inclined downward (the direction indicated by arrow Z1) from the slots 31.

Gaps 35 are formed between the ends 40*b* of the guide members 40 and the second surface 33. The papers OP which have slid off the guide members 40 fall downward (the direction indicated by the arrow Z1) through the gaps 35. Thereby, the papers which have been ejected from the printing engines 10, 11, 12, and 13 slide along the guide members 40 from the slots 31 toward the ends 40*b*, then fall through the gaps 35.

The guide ribs 50 are provided on the guide members 40. The guide ribs 50 serve to regulate movement of the papers OP on the guide members 40. The guide ribs 50 serve to regulate movement of a second paper OP2 having a smaller width (e.g., 3×5) than the first paper OP1, which is inserted through the slots 31 from the printing engines 10, 11, 12, and 13, in its widthwise direction (the direction indicated by the arrow X) Specifically, the guide ribs 50 are provided at positions that allow the second paper OP2 to pass between them and a side wall 34*b* of the chute box 30, while preventing the second paper OP2 from rotating. Thereby, when the second paper OP2 is inserted from the slots 31, movement in the widthwise direction thereof is regulated by the guide ribs 50, in cooperation with the side wall 34*b*.

Here, the guide ribs 50 are provided so that the widths between them and the side wall 34*b* narrow toward the second surface 33 of the chute box 30 from the ends 40*a* (at the side of the slots 31) of the guide members 40. Therefore, even in the case that the second paper OP2 is inserted from the slots 31 shifled in the direction of the arrow X, or inclined with respect to the direction indicated by arrow X, the second paper 0P2 is guided while its widthwise movement is regulated, and caused to fall through the gap 35 at substantially the same position. Note that in the case that a plurality of first papers OP1 are shifled in their widthwise directions (the direction indicated by the arrow X) when inserted through the slots 31, they are caused to fall in an aligned state by side walls 34*a* and 34*b*.

Figure 5:
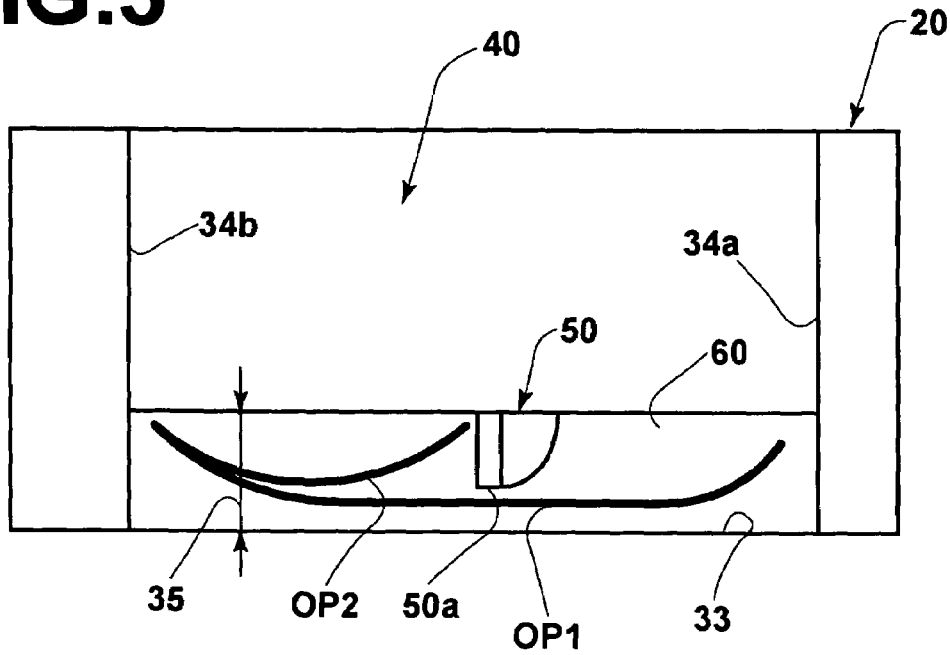
FIG. 5 is a schematic view showing a gap of a guide member of the paper discharge unit of FIG. 3.

Further, upper edges 50*a* of the guide ribs 50 are provided to approach the second surface 33 of the chute box 30 toward the ends 40*b* of the guide members 40. As shown in FIG. 5, which is a bottom plan view of the gap 35, the upper edges 50*a* contact the curled first sheet OP1, to regulate rotation thereof.

Elastic sheet members 60, formed of plastic film or the like, are attached to the ends 40*b* of the guide members 40. The sheet members 60 are attached to the ends 40*b* of the guide members 40, and extend downward (the direction indicated by the arrow Z1) into the gap 35. The sheet members 60 are in contact with the second surface 33 of the chute box 30, and the papers OP fall between the sheet members 60 and the second surface 33. At this time, the sheet members 60 apply force to the papers OP in the direction that presses them toward the second surface 33 (the direction indicated by arrow Y2). This force prevents the papers OP from getting stuck on the other guide members 40 along their descent, thereby preventing paper jams.

Figure 6:
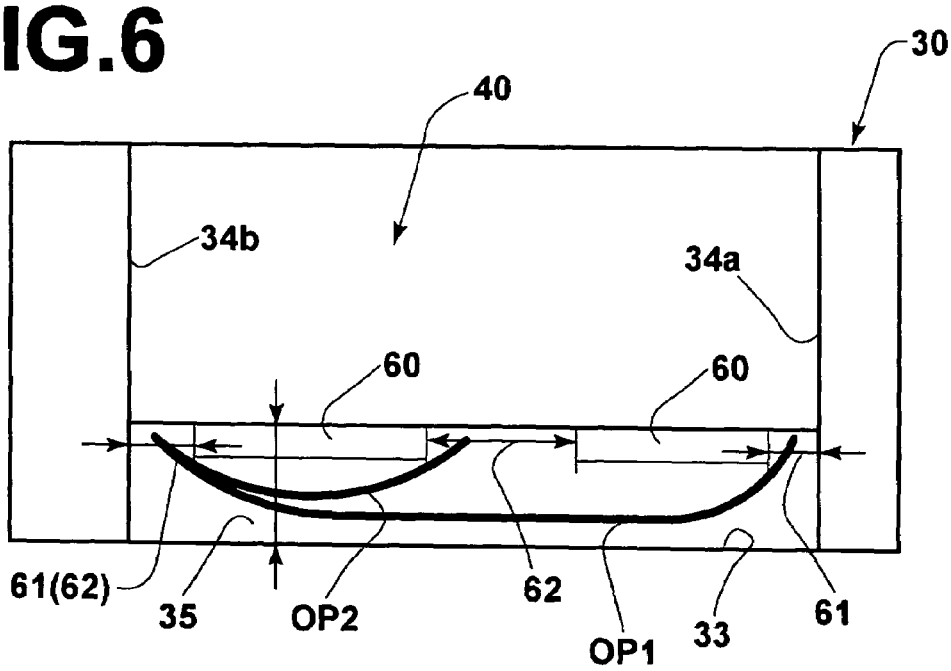
FIG. 6 is a schematic view showing sheet members provided in the gap of the paper discharge unit of FIG. 3.

As shown in FIG. 6, the sheet members 60 have first spaces 61 for accommodating both widthwise edges of the first sheets OP1; and second spaces 62 for accommodating both widthwise edges of the second sheets OP2. Thereby, the curled first papers OP1 and the curled second papers OP2 fall along the sheet members 60 in a state in which both edges thereof are accommodated within the first spaces 61 and the second spaces 62. Therefore, rotation of the first papers OP1 and the second papers OP2 during their descents is prevented.

Figure 7:
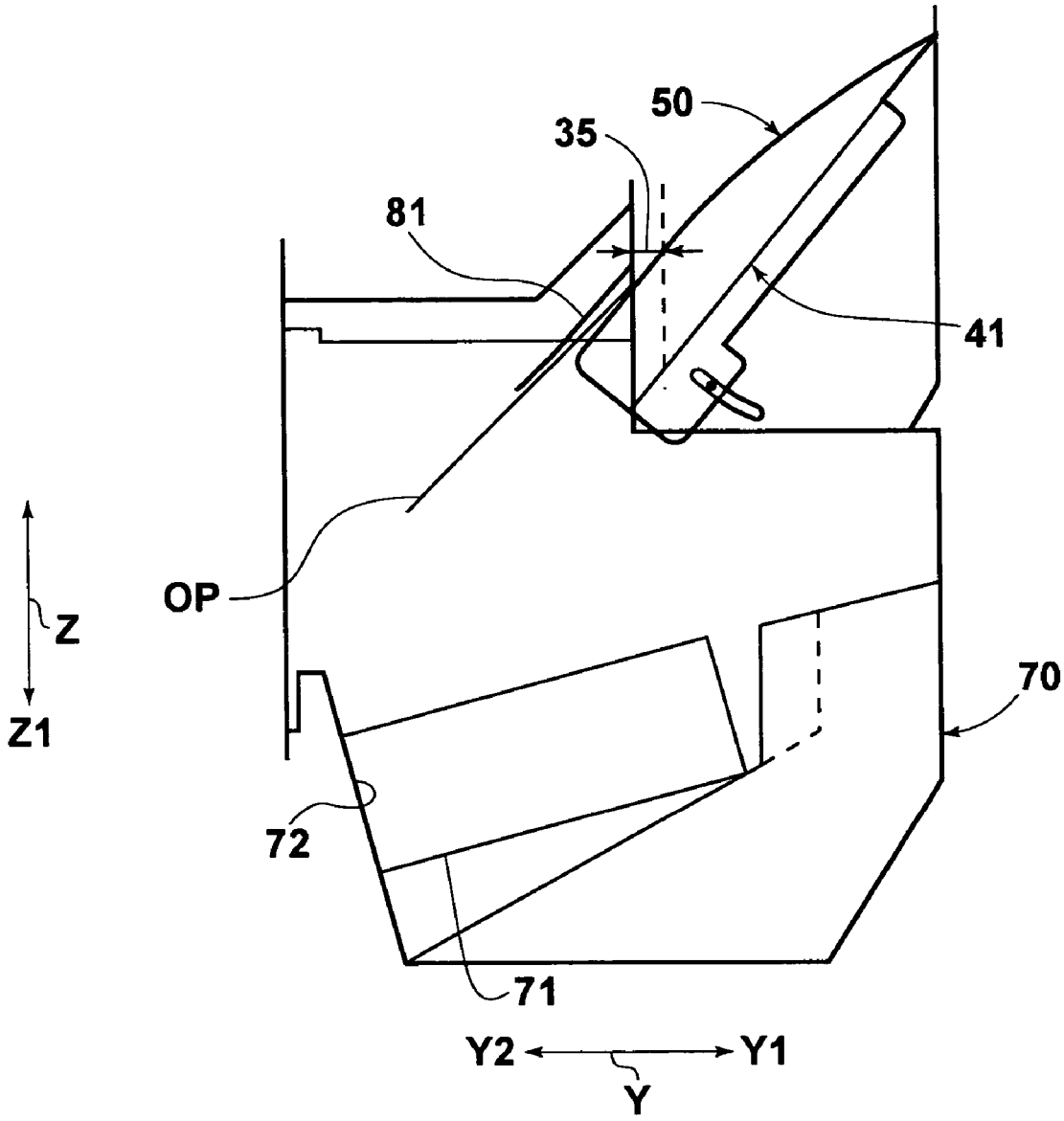
FIG. 7 is a schematic view showing the periphery of a paper housing portion of the paper discharge unit of FIG. 3.

As shown in FIG. 7, the paper housing portion 70 is placed beneath the chute box 30. The paper housing portion 70 stacks and houses the papers OP which have fallen through the chute box 30. A housing surface 71 is inclined with respect to the X-Y plane. A substantially flat surface 72 is provided on the downstream side of the housing surface 71. The edges of the papers OP, which fall from the chute box 30, strike the housing surface 71, move toward the downstream side thereof, and the edges are aligned by the flat surface 72. Meanwhile, the papers OP fall in a state in which movement in the widthwise directions (the direction indicated by the arrow X) thereof is restricted by the side walls 34*a*, 34*b*, and the guide ribs 50. Therefore, the papers OP fall at substantially the same positions in the X direction (refer to FIG. 4). Accordingly, when the papers OP are stacked, their edges are aligned.

A position controlling member 80 is mounted beneath the chute box 30, on the upper part of the paper housing portion 70. The position controlling member 80 comprises a position controlling sheet 81 and the lowest guide member 41. The lowest guide member 41 is provided to extend from the slot 31 so that a portion of the second surface 33 is positioned above the gap 35. The position controlling sheet 81 is attached to the lowermost portion of the chute box 30, and extends downward so as to contact the surface of the lowest guide member 41. The edges of the papers OP which have fallen through the gap 35 strike the lowest guide member 41, and the papers OP are caused to be laid in the Y direction. At this time, the position controlling sheet 81 aids in the laying of the papers OP by applying a force thereon in the direction toward the slots 31 (the direction indicated by arrow Y1). Thereafter, the papers OP move toward the downstream side of the lowest guide member 41, and fall into the paper housing portion 70.

That is, the papers OP fall in the direction indicated by the arrow Z, oriented in an erect position by the guide members 40 and the sheet members 60. If the papers OP fall into the paper housing portion 70 in this state, shock will be applied to the papers OP already stacked therein, possibly causing damage thereto. At this time, by the position controlling member 80 laying the papers OP down from their erect positions, the shock applied to the papers OP which are already stacked within the paper housing portion 70 is reduced. Thereby, damage to the papers OP is prevented.

Figure 8:
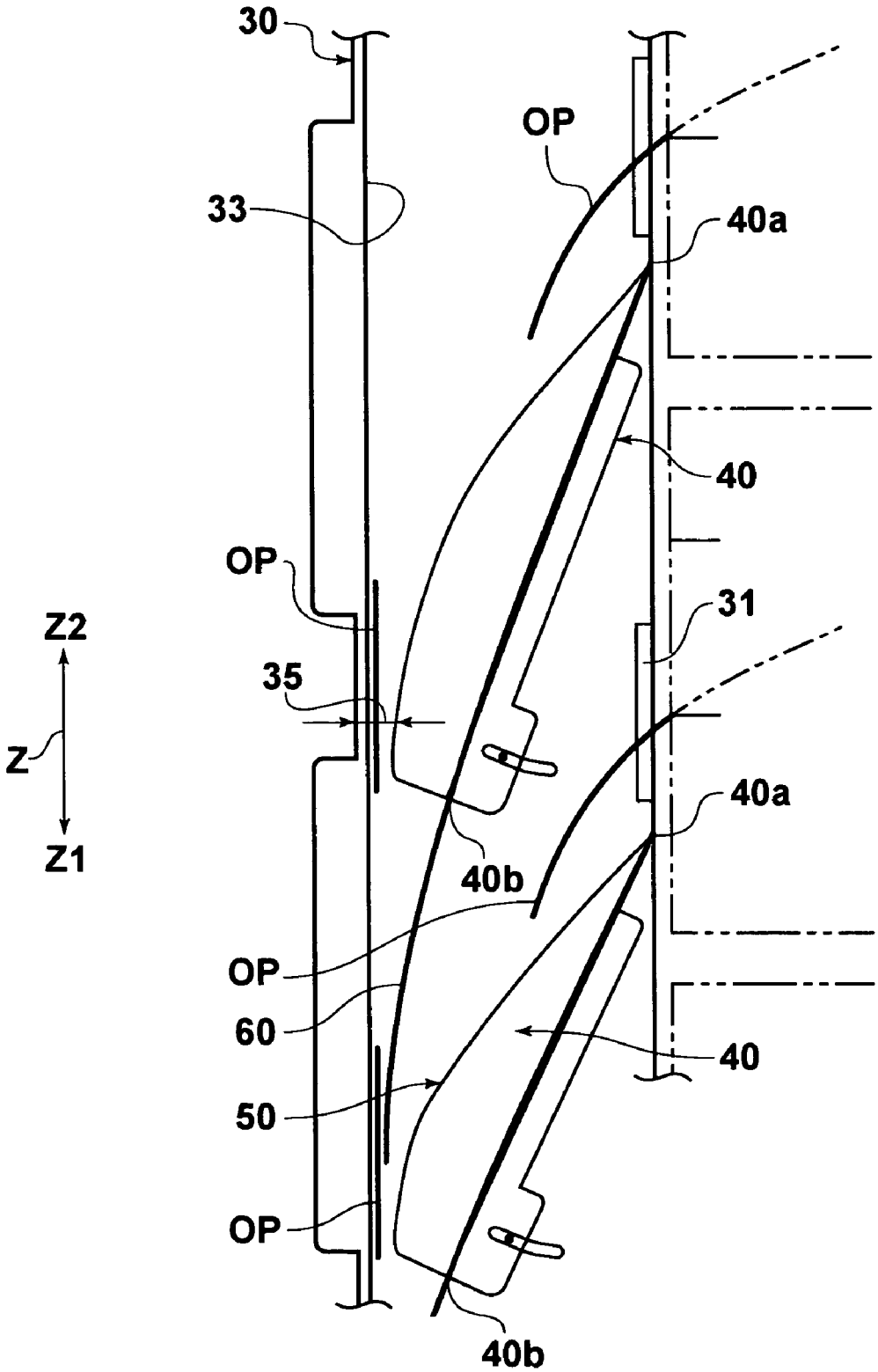
FIG. 8 is a schematic view showing the manner in which papers fall from the guide members of the paper discharge unit of the present invention.

FIG. 8 is a schematic diagram showing the movement of the paper OP from the slots 31 to the gap 35. An example of the operation of the paper stacking portion 20 will be described with reference to FIG. 1 through FIG. 8. First, papers OP ejected from the printing engines 10, 11, 12, and 13 are inserted into the chute box 30 through the slots 31. Then, the papers OP are guided by the guide members 40 to slide into the gap 35. At this time, the first papers OP1 are regulated in their widthwise movement by the side walls 34*a* and 34*b* of the chute box 30. Meanwhile, the second papers OP2 are regulated in their widthwise movement by the guide ribs 50 and the side wall 34*b*. All of the first papers OP1, having been guided by the side walls 34*a* and 34*b*, fall from substantially the same position of the gap 35. All of the second papers OP2, having been guided by the side wall 34*b* and the guide ribs 50, fall from substantially the same position of the gap 35, after sliding along the inclined guide members 40.

Thereafter, the papers OP which fall through the gap 35 descend while being pressed against the second surface 33 by the sheet members 60. Further, the first papers OP1 and the second papers OP2 fall while being restricted from rotating by the first spaces 61 and the second spaces 62, respectively.

Then, when the papers OP have fallen to the lowermost portion of the chute box 30, the papers OP fall into the paper housing portion 70 in a state in which they are laid down in the Y direction. The edges of the papers OP are aligned by the flat surface 72, and the papers OP are stacked.

According to the embodiment described above, when papers OP are inserted into the chute box 30 and move therethrough while being guided by the guide members 40, movement of the first paper OP1, having the largest width, is regulated by the side walls 34*a* and 34*b* of the chute box 30. Meanwhile, widthwise movement of the second paper OP2 is regulated by the side wall 34*b* and the guide ribs 50. Therefore, even in the case that papers OP of different sizes are inserted from the slots 31, the second paper OP2 does not rotate within the chute box. Accordingly, the first papers OP1 and the second papers OP2 are respectively discharged from the chute box 30 at substantially uniform positions.

The guide ribs 50 are provided so that the width between them and the side wall 34*b* becomes narrower toward the second surface 33 of the chute box 30. Therefore, even if a plurality of the second papers OP2 are inserted into the slots 31 in a state that they are slightly shifted in the width directions thereof, they are caused to fall from substantially the same position.

The guide ribs 50 are also provided so that the upper edges 50*a* thereof approach the second surface 33 of the chute box 30 toward the end of the guide ribs 50 away from the slots 31. Therefore, the first papers OP1 which pass over the guide ribs 50 can be positively be guided to the gap 35 formed between the guide members 40 and the second surface 33 of the chute box 30.

Downwardly extending sheet members 60 are provided at the distal ends of the guide members 40, the sheet members 60 being in contact with the second surface 33 of the chute box 30. Therefore, the papers OP which fall through the gap 35 are urged toward the second surface 33 of the chute box 30. Accordingly, the papers OP do not strike other guide members 40 along their descent.

Further, the sheet members 60 are provided with the first spaces 61 for both edges in the width direction of the first paper OP1 to be inserted in, and the second spaces 62 for both edges in the width direction of the second paper OP2 to be inserted in, in the case that the first and second papers are curled in the cross section of their width directions. Therefore, rotation of the first papers OP1 and the second papers OP2 is prevented.

Still further, the position controlling member 80 for causing the papers OP which fall through the chute box 30 to be stacked in the same direction is provided between the chute box 30 and the paper housing portion 70. Therefore, the papers OP which fall into the paper housing portion 70 are stacked in an arranged state.

The present invention is not limited to the embodiment described above. For example, guide ribs 50 for guiding papers OP of the 3×5 size are provided on the guide members 40. However, guide ribs 50 may be provided for guiding papers OP of the postcard size or the CD size. In addition, a single guide rib 50 for guiding the papers OP of the 3×5 size is provided on each guide member 40. However, a plurality of guide ribs 50, for guiding papers OP of the 3×5 size, the postcard size, and the CD size, respectively, may be provided on each guide member 40.

In this case, in the same manner that the guide ribs 50 do not interfere with the movement of the curled first papers OP1, the guide ribs for the papers OP of the postcard size and the guide ribs for the papers OP of the CD size do not interfere with the curled papers OP of the 3×5 size. Movement of the postcard size papers OP and the CD size papers OP on the guide member 40 is also restricted. Therefore, rotation of all of the papers OP on the guide members 40 is prevented.

What is claimed is:

1. A paper discharge unit comprising:

a chute box having a plurality of slots for inserting papers of different sizes thereinto, provided at different heights in a first surface thereof;

a plurality of guide members, inclined downwardly from the plurality of slots, provided to form a gap through which the papers fall toward a second surface of the chute box facing the first surface in which the plurality of slots are formed; and a plurality of guide ribs, wherein the chute box is provided with side walls for regulating widthwise movement on the guide member of a first paper, having the largest width among the papers; and each of the guide members is provided with one of said guide ribs for regulating widthwise movement of a second paper, which is smaller than the first paper, in cooperation with one of the side walls, the guide ribs extending from the slots to the second surface of the chute box, wherein:

the guide ribs are provided so that the width between each of them and the one of the side walls becomes narrower toward the second surface of the chute box.

2. A paper discharge unit as defined in claim 1, wherein:

the guide ribs are provided so that upper edges thereof approach the second surface of the chute box toward the ends of the guide ribs away from the slots.

3. A paper discharge unit as defined in claim 1, further comprising:

downwardly extending sheet members provided at distal ends of the guide members, the sheet members being in contact with the second surface of the chute box.

4. A paper discharge unit as defined in claim 3, wherein:

for first and second papers which are curled in the cross section of their width directions each sheet member is provided with a first space for both edges in the width direction of the first paper to be inserted in, and a second space for both edges in the width direction of the second paper to be inserted in.

5. A paper discharge unit as defined in claim 1, further comprising:

a paper housing portion, for stacking and housing the papers, provided below the chute box; and a position controlling member, for causing the papers which fall through the chute box to be stacked in the same direction, provided between the chute box and the paper housing portion.

6. A printing apparatus comprising:

a plurality of printing engines capable of discharging papers of different sizes on which images are printed, the printing engines being housed in the printing apparatus in a stacked manner;

a chute box having a plurality of slots for inserting thereinto papers of different sizes which are discharged by the printing engines, each of said slots being associated with a different one of the printing engines, and being arranged at a different height in a first surface of the chute box;

a plurality of guide members, inclined downwardly from the plurality of slots, provided to form a gap through which the papers fall toward a second surface of the chute box facing the first surface in which the plurality of slots are formed; and a plurality of guide ribs, wherein the chute box is provided with side walls for regulating widthwise movement on the guide member of a first paper, having the largest width among the papers; and each of the guide members is provided with one of said guide ribs for regulating widthwise movement of a second paper, which is smaller than the first paper, in cooperation with one of the side walls, the guide ribs extending from the slots to the second surface of the chute box; and wherein the guide ribs are provided so that the width between each of them and the one of the side walls becomes narrower toward the second surface of the chute box.

* * * * *